United States Patent [19]

Jacobs et al.

[11] Patent Number: 4,795,071

[45] Date of Patent: Jan. 3, 1989

[54] COPYING MACHINE HAVING A SHEET STAPLING DEVICE

[75] Inventors: Gerardus M. H. M. Jacobs, Velden; Ronald P. H. in't Zandt, Venlo, both of Netherlands

[73] Assignee: Oce-Nederland B.V., Venlo, Netherlands

[21] Appl. No.: 861,518

[22] Filed: May 9, 1986

[30] Foreign Application Priority Data

May 10, 1985 [NL] Netherlands ..... 8501337

[51] Int. Cl.[4] ..... B27F 7/17; B42B 5/08; B21J 15/28

[52] U.S. Cl. ..... 227/7; 412/6

[58] Field of Search ..... 227/7, 1, 2; 412/2, 412/3, 4, 5, 6, 7, 8, 33

[56] References Cited

U.S. PATENT DOCUMENTS

| | | | |
|---|---|---|---|
| 4,134,672 | 1/1979 | Burlew et al. | 412/6 X |
| 4,184,622 | 1/1980 | Spehrley, Jr. | 227/119 X |
| 4,575,296 | 3/1986 | Rockler et al. | 412/6 |

OTHER PUBLICATIONS

*Original Re-Staple,* Xerox Disclosure Journal, Crandell, M. G., vol. 8, No. 4, Jul./Aug. 1983, pp. 309–311.

*Primary Examiner*—Paul A. Bell

[57] ABSTRACT

A copying machine is provided with a sheet stapling device for both automatically fastening together in a corner area a bundle of sheets successively printed in the copying machine and fastening together a bundle of sheets manually inserted in an externally accessible opening formed in the side of the stapling device. Preferably, the opening is formed by an elongated slot which extends to the operating side of the copying machine and which coincides with the opening through which sheets printed in the copying machine are discharged from the stapling device. A bundle of sheets can be inserted in the opening so that any edge part is under the stapling means. Thus, the inserted bundle can be stapled at different places along any edge. The opening is provided with two detectors to determine when a bundle of sheets inserted manually is correctly positioned under the stapling device and to initiate the stapling action.

14 Claims, 3 Drawing Sheets

COPYING MACHINE HAVING A SHEET STAPLING DEVICE

BACKGROUND OF THE INVENTION

1. Field of the Invention

The present invention relates to a copying machine provided with a sheet stapling device.

2. Description of the Prior Art

The Xerox Disclosure Journal Vol. 8, No. 4, of July/August 1983, pages 309–311, describes a copying machine with a sheet stapling device. In this machine, the images are applied to the copy sheets in such an orientation that the copies arrive in a collecting tray with the side to be stapled facing away from the operating side of the machine. To staple the copy sheets collected in the tray in the upper left-hand corner relative to the image, the stapling means is necessarily arranged in the hindmost part of the copying machine facing away from the operating side of the copying machine.

Rising above the rest of this copying machine is a cap which covers the hindmost part of the collecting tray. An elongated rectangular slot is formed in the front wall of this cap permitting a bundle of sheets to be inserted manually under the stapling means. During insertion, the bundle slides in an inclined downward direction on the hindmost part of the horizontal plate of the collecting tray. In the stapling position, the bundle will be bent because it is held by hand and the parts of the sheets situated under the stapling means will be shifted imbricately. If a bundle inserted into the slot is relatively thick, this shifting will be relatively large. This will cause the sheets to be stapled at a place where they have been shifted imbricately forming a bundle of incorrectly fastened sheets.

The latter drawback of this copying machine might be met somewhat by enlarging the distance between the slot and the stapling means permitting the bundle to be inserted less obliquely into the slotted opening. However, the bundle in the Xerox machine is to be passed practically wholly through the slot and, consequently, its proper holding would no longer be possible if the distance was increased. Moreover, increasing the distance increases the risk that in sliding on the horizontal plate the lowermost sheet of the bundle will be arrested and will not properly arrive under the stapling means.

U.S. Pat. No. 4,184,622 describes a typical stapling device used in a copying machine to staple sets of copy sheets formed in the copying machine. The copying machine described in this patent, however, is not adapted for stapling a bundle of sheets inserted manually into the machine.

None of the above-described copying machines are suitable both for stapling sets of sheets easily inserted manually in a flat condition under the stapling device and for automatically stapling sets of copy sheets formed in the copying machine.

SUMMARY OF THE INVENTION

Generally, the present invention provides a copying machine which does not have the drawbacks mentioned hereinbefore. A copying machine having a sheet stapling device comprising a support for collecting sheets printed in the copying machine into a bundle; a stapling means for fastening together a bundle of collected sheets at an edge; a means for discharging the bundle of collected sheets from the support; and an externally accessible opening in the sheet stapling device through which a bundle of sheets can be manually inserted until the stapling means wherein both the stapling means and the opening have been provided at the same part of the support on which a corner area of the bundle of collected sheets is situated.

In an attractive embodiment of a copying machine according to the present invention the images are applied to the copy sheets in such an orientation that the copies arrive at the collecting point with the side to be stapled near the operating side of the copying machine. Thus, both the stapling means and the opening therein can be provided near the operating side of the copying machine so that a bundle of manually introduced sheets can be brought easily into a flat condition until the stapling means. Only the corner of the bundle of sheets has to be inserted through the opening and under the stapling means. Furthermore, by inserting the bundle in an otherwise arbitrary orientation, the bundle can be stapled along any edge adjacent a corner area as the user desires.

In a still more attractive embodiment of a copying machine according to the present invention, the opening for manually inserting a bundle of sheets is the same as the elongated opening through which the bundle of collected sheets is discharged from the support. The elongated opening can be closed by a stop for retaining processed sheets fed onto the support. The stapling means is arranged so that it can staple a bundle of sheets along an edge extending lengthwise from the opening. In this way, a bundle of sheets manually inserted into the opening can be fastened together at arbitrary places along an edge part. This is particularly desired for fastening together a bundle of sheets printed on either side in a number of places along an edge.

Other features and advantages of the present invention will be apparent from the following detailed description and with reference to the accompanying drawings.

DESCRIPTION OF THE PREFERRED EMBODIMENTS

Figure 1:
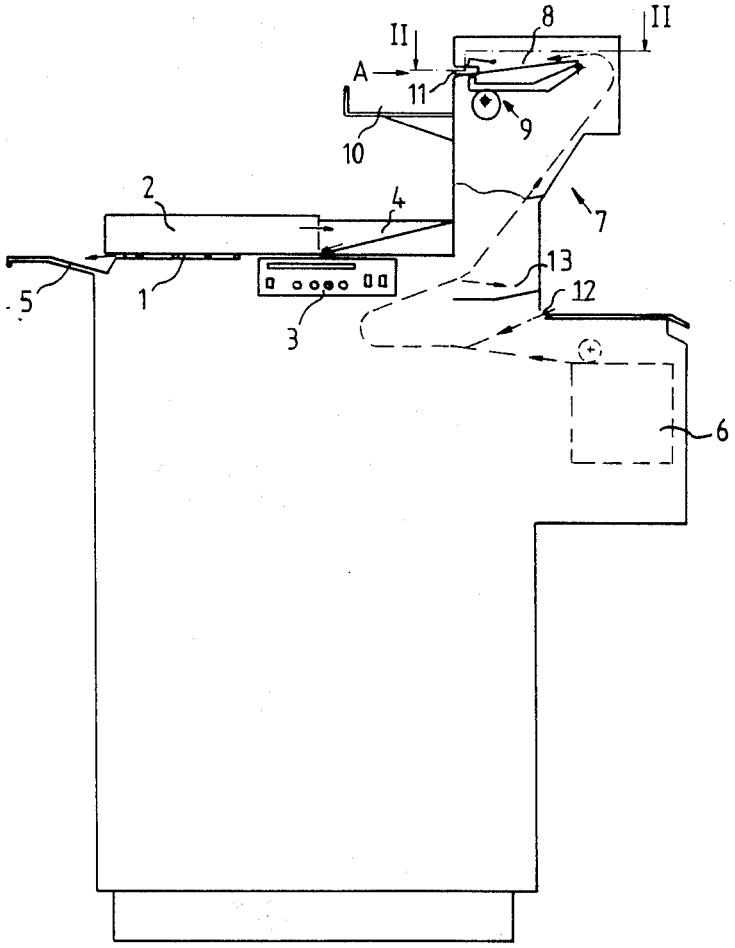
FIG. 1 is a front view of a copying machine provided with a sheet stapling device, according to the present invention.

The copying machine represented in FIG. 1 is provided at the top side with a glass plate 1 upon which an original to be copied can be laid down. Glass plate 1 and an original positioned thereon can be covered by a cover 2 fitted with a conveyor belt for feeding an original onto glass plate 1 o discharging it therefrom. An original positioned on glass plate 1 can be copied on a sheet of receiving material by means of a copying system (not shown). An operating panel 3 is placed at the front of the copying machine.

Viewed from the operating side of the copying machine, a feed tray 4 for a set of originals to be copied is arranged to the right of glass plate 1. A delivering tray 5 is arranged to the left of glass plate 1. With the aid of a conveyor means (not shown), including the conveyor belt in cover 2, originals placed in feed tray 4 can be conveyed one by one to glass plate 1 and, after being exposed, can be returned to feed tray 4. For making the next set of copies, the set of originals returned to feed tray 4 is again conveyed one by one to glass plate 1. After the last exposure is completed, the originals of the set are discharged to delivering tray 5.

The copying machine can be provided with an exposure control which is adapted to operate in an automatic mode or in a manual mode. When the automatic mode is selected and the originals are fed by the conveyor belt onto glass plate 1, a detector measures the background of the original to be copied and the measuring signal is used for adjusting the exposure. When the manual mode is selected and the originals are positioned manually onto glass plate 1, the operator can use a keyboard for adjusting the exposure.

When the manual mode is selected, the detector remains energized. In this situation, the measuring signal is sent to a comparator which compares the signal with a signal that is representative for the exposure which has been selected by the operator. If the difference between the two signals exceeds a predetermined value, a warning signal is generated.

The copying machine includes a sheet magazine 6 for holding a stack of sheets of copy material. With the aid of a conveyor means (not shown) these sheets can be conveyed one by one along the path represented in a broken line through the copying machine for successively taking images of the originals positioned on glass plate 1.

The copying machine has a unit 7 which, viewed from the operating side of the copying machine, is located to the right of feed tray 4 and rises above the rest of the copying machine. Unit 7 houses a collecting tray 8 in which a set of imaged copy sheets can be collected Further, a stapling device 9 used to fasten together the bundle of collected sheets is accommodated in unit 7. An outlet opening 11 is provided in the left-hand wall of unit 7 through which sets of copies collected in collecting tray 8—fastened together or not—can be conveyed into receiving tray 10. More details of the arrangement of unit 7 and it operation will be described hereinafter with reference to FIGS. 2 and 3.

The copying machine represented in FIG. 1 is provided with an inlet opening 12 through which special sheets of copy material can be introduced manually one by one into the copying machine. It also has a discharging section 13 along which these special sheets are discharged after being printed in the copying machine. These special sheets of copy material may, for example, be sheets which are not suitable on account of their sizes or their material properties to being stored in magazine 6 and/or in collecting tray 8.

Inlet opening 12 can also be used for feeding cover sheets. For example, from a set of one-sided originals, a bundle of copy sheets can be made wherein the first sheet is a cover sheet which is printed on only one side with the other sheets being printed on both sides. To make such a bundle, the set of originals is placed in feed tray 4 and circulated two times past glass plate 1. During the first circulation, only the third numbered original and the following odd numbered originals are successively imaged onto sheets fed from magazine 6. These copy sheets are laid back in feed tray 4 with the printed sides upwards. In the second circulation of the originals, the first numbered original is imaged onto a cover sheet which was laid ready in inlet opening 12. Then, only the even numbered originals are successively imaged onto the unprinted sides of the copy sheets laid back in feed tray 4. To fasten together the bundle of copy sheets, the stapling device 9 can be activated after the second circulation of originals.

To fasten together a bundle of sheets held by hand, for instance, a bundle of originals removed from tray 5, a bundle of copies not yet fastened together removed from tray 10 or a bundle of special copy sheets discharged from the copying machine via discharging section 13, the bundle can be inserted outwardly into outlet opening 11 as will be explained in more detail with reference to FIGS. 2 and 3.

Figure 2:
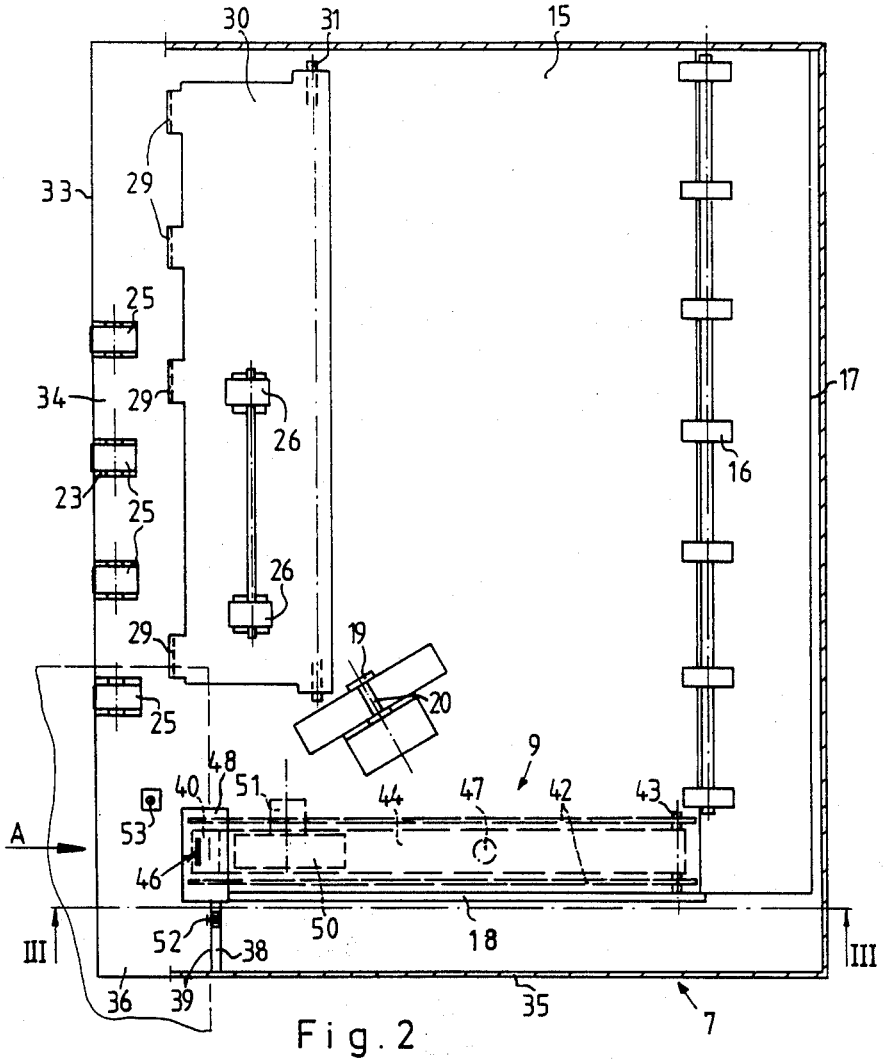
FIG. 2 is a cross-section taken along line II—II of the sheet device shown in FIGS. 1 and 3.
Figure 3:
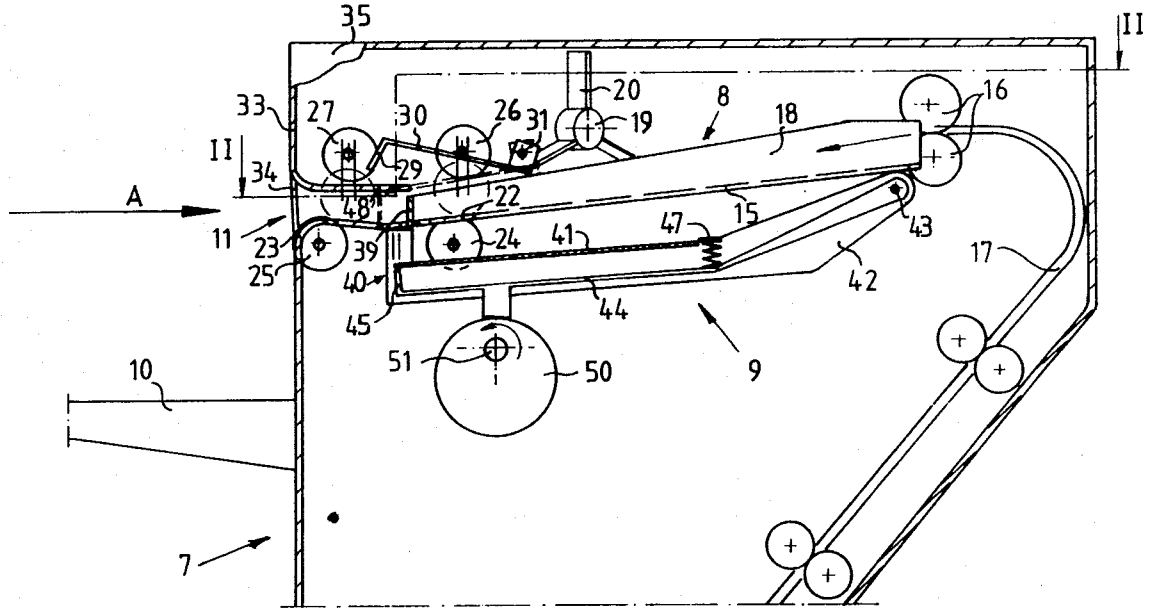
FIG. 3 is a cross-section taken along line III—III of the sheet stapling device shown in FIG. 2.

Unit 7 of the copying machine, represented in more detail in FIGS. 2 and 3, comprises an inclined plate 15 forming the bottom of collecting tray 8. Conveyor roller pairs 16 are arranged along the upper edge of plate 15 for feeding copy sheets coming along path 17 from the copying section of the machine onto plate 15.

Openings 22 and 23, respectively, are formed in base plate 15 through which drive rollers 24 and 25, respectively, protrude. Freely rotatable pressure rollers 26 and 27, respectively, are fitted above drive rollers 24 and 25, respectively, such that each pressure roller forms a pair with one of the drive rollers. Each of the pressure rollers 26 and 27, with the aid of a moving means (not shown), are moveable between a position in which they are some distance above the drive roller with which they form a pair and a position in which they press on the associated drive roller.

Between roller pairs 24, 26 and 25, 27 is a stop plate 29 which extends parallel to the axes of the rollers. Stop plate 29 is arranged above plate 15 and is connected to an arm 30 which is rotatable about a shaft 31. By a means (not shown), stop plate 29 can be put into an inoperative position as shown by the full lines in FIG. 3 wherein it is situated completely above opening 11 and into an operative or activated position wherein it protrudes through an opening formed in plate 15 as shown by the dotted lines in FIG. 3.

At the operating side of the copying machine, a wall plate 18 is secured to base plate 15 and forms a stop surface for a side edge of sheets fed onto base plate 15 by rollers 16. A transport wheel 19, provided with flexible projections 20, is positioned in an inclined position above base plate 15 and presses sheets fed onto plate 15 against wall plate 18 and activated stop plate 29 forming a straight stack of sheets.

An elongated slot 34 is formed in frame plate 33 at the side of unit 7. A recess 36 is formed in frame plate 35 at the front of unit 7 which connects to slot 34. Slot 34 and recess 36 together form opening 11. Base plate 15 connects to frame plates 33 add 35, respectively, at the lower edge of slot 34 and recess 36. An edge portion 38 of wall plate 18 is bent over and forms a stop surface 39 bounding the depth of opening 11.

A stapling device 9 is arranged near the operating side of the copying machine under the part of base plate 15 which forms the lower boundary of opening 11. This device is known to those skilled in the art and, therefore, is only represented schematically in the figures. As shown in FIG. 3, stapling device 9 comprises a stapling head 40 with a magazine 41 for staple bars which magazine is secured between two levers 42 pivotable upon a fixed pin 43 mounted below base plate 15 near roller pairs 16. An arm 44, also pivotable upon pin 43, is fitted between levers 42. Arm 44 is supported by a cam roller 50, which can pivot upon an eccentrically placed shaft 51 which shaft is connected to a drive motor via a one revolution clutch. The free end 45 of arm 44 is bent upwardly and forms a buffer for bending a staple bar into a U shape for ejecting the resulting staple out of stapling head 40 at the location indicated by 46 in FIG. 2 and for pushing this staple through a bundle of sheets positioned on base plate 15.

When stapling head 40 is in the rest position, as shown in FIG. 3, a compression spring 47 mounted between levers 42 and arm 44 keeps arm 44 at a distance from the foremost staple bar. Compression spring 47 also compensates for differences in thickness of the bundle of sheets to be stapled upon upward movement of stapling head 40. Upon a rotation of cam roller 50 about shaft 51, the entire stapling head 40 is first pressed upwardly from its resting position shown in FIG. 3 so that stapling head 40 protrudes through a hole in base plate 15 and presses a bundle of sheets positioned thereon against an anvil 48 which bounds the upperside of opening 11. Upon continued rotation of cam roller 50, only arm 44 is pressed upwardly while spring 47 is compressed whereupon buffer 45 bends a staple bar into a U-shape with legs and pushes the staple with its legs through the bundle of sheets until the legs are bent against anvil 48 and are pressed flat against the bundle. Upon a further continuation of rotation of cam roller 50 stapling head 40 will drop below base plate 15 and continue to drop until it arrives in its initial resting position.

A microswitch 52 is positioned in opening 11 a short distance before stop surface 39. The switching point of microswitch 52 is approximately 0.5 mm in front of stop surface 39. Microswitch 52 is situated within the dihedral angle formed by stop surface 39 and the plane passing through stapling location 46 and the side edge of stop surface 39 facing away from stapling location 46. A detector 53 is disposed near opening 11 such that when viewed in the direction of discharge, i.e. lengthwise of the externally accessible opening it is situated on the other side of stapling location 46 from microswitch 52. Additionally, detector 53 is located before stapling location 46 while microswitch 52 is located behind stapling location 46.

The operation of the sheet stapling device will now be described. In the stand-by position of the copying machine, pressure rollers 26 and 27 and stop plate 29 are in the positions represented in FIG. 3 by the full lines. In this position, it is possible to insert a bundle of sheets from outside the copying machine into opening 11 until beyond stapling position 46 as will be explained in detail hereinafter.

If the copying machine is set to produce stapled bundles of copies of a bundle of originals placed in feed tray 4, stop plate 29 will be automatically put into the operative position upon putting the copying machine in operation. The stapler motor will be switched on and a first set of copies is made of the originals placed in tray 4. After a reproduction has been made, the originals are placed back into tray 4. The copies are placed in collecting tray 8 by rollers 16 via path 17 where they are positioned by means of transport wheel 19 and on top of each other on base plate 15 against stop plate 29 and wall plate 18.

After the last copy sheet of a bundle has been positioned in collecting tray 8, the control device (not shown) of the copying machine energizes the one revolution clutch between stapler motor and roller shaft 51 to activate stapling head 40. Stapling head 40 then forces a corner area of the collected set of copy sheets upwardly against anvil 48 and, subsequently, pushes a staple through the sheets.

After stapling head 40 has returned to its initial resting position, the control device of the copying machine lifts stop plate 29 until it is above opening 11 and moves pressure roller 26 downwards and presses it against the collected set which causes the stapled bundle of copies to be conveyed by drive roller 24 in the direction of opening 11. After the stapled bundle of copies has arrived in the space between rollers 25 and 27, but still being free of each other, the control device moves pressure roller 27 downwards and pressure roller 26 upwards causing tee stapled bundle of copies to be conveyed further through opening 11 to receiving tray 10 only by roller pair 25, 27.

At the end of the cycle for making a stapled set of copies, the control device of the copying machine releases pressure roller 27 from drive roller 25. This cycle is repeated for making each subsequent set of copies of the originals placed in tray 4. During the last cycle, the originals are directed to delivery tray 5 instead o being returned to feed tray 4.

After making the last set of copies, the stapler motor continues running for a certain period, such as 10 seconds. The lighting up of an LED disposed near opening 11 is indicative of the stapler motor being switched on. In this period, the set of originals can be removed from delivering tray 5, can be inserted into opening 11 in the direction indicated with arrow A and be positioned against stop surface 39. This will successively cause a beam of light thrown by a lamp in the direction of detector 53 to be interrupted and microswitch 52 to be activated. Responding to the receipt of detection signals from both detector 53 and microswitch 52, which will be the case when the bundle has been correctly positioned, the control of the copying machine energizes the one revolution clutch and a staple is passed through the bundle of sheets manually inserted into opening 11. When the bundle fails to activate detector 53 or when the bundle is held in such an oblique position against stop surface 39 that microswitch 52 falls to be activated, stapling head 40 will remain inoperative. Thus, it is ensured that a staple is always passed through the bundle in a straight position and at a defined distance from the side edge.

As shown in FIG. 2 by the broken line, the set of originals or a bundle of other sheets not only can be positioned in opening 11 with a corner area above stapling head 40 to staple the bundle in that corner area, but it can be inserted with a longer edge part above stapling head 40 to staple the bundle at other places or at a number of places along an edge. During the period in which the stapler motor continues running, such as after making a last copy or after the last stapling action, it is also possible to insert copies into opening 11 that have not been stapled automatically in the collecting position, such a special copies discharged from the copying machine via discharging section 13 and normally discharged copies intended to be stapled at two or more positions along an edge, for example, when the copy sheets have been printed on either side in the machine.

To distinguish between nonfastened together sets of copies which are successively fed into it, receiving tray 10 is slidable between two positions, and each time after receipt of a complete set, receiving tray 10 is automatically put in the other position. As a result, the sets will be deposited into receiving tray 10 in positions shifted from each other and can easily be removed from it one by one and be inserted into opening 11 for being stapled.

After the lapse of the period in which the stapler motor continues running, the copying machine has returned to the stand-by position. In this position, the sheet stapler device can also be used, for example, for stapling bundles of sheets that have not been handled on the copying machine. If, in this position, a bundle of sheets is inserted into opening 11 and kept against stop surface 39, such that detector 53 and microswitch 52 are successively activated, the stapler motor and, after a short starting period of, for example, 2 seconds, the one revolution clutch for stapling the bundle of sheets will be energized.

The copying machine can also be set to a printing mode in which copies are not collected into sets in tray 8 but are fed directly to tray 10. With this setting, stop plate 29 is kept in the lifted position as shown in FIG. 3 and the pressure rollers 26 and 27, respectively, are kept in permanent pressure contact with drive rollers 24 and 25, respectively. Each copy sheet supplied by rollers 16 is then directly fed over plate 15 into receiving tray 10 by roller pairs 24, 26 and 25, 27.

While a presently preferred embodiment of the invention has been illustrated and described, variations and modifications may b apparent to those skilled in the art. These are contemplated as being within the scope of the following claims which particularly point out and distinctly claim the subject matter regarded as the invention.

What is claimed is:

1. A copying machine having a sheet stapling device comprising a support for collecting sheets printed in the copying machine into a bundle; a stapling means for fastening together a bundle of collected sheets at an edge; a means for discharging the bundle of collected sheets from the support through an elongated opening; and an externally accessible opening in the sheet stapling device through which a bundle of sheets can be manually inserted such that only a small portion of the bundle needs to be inserted before it is aligned with the stapling means and wherein both the stapling means and the opening have been provided at the same part of the support on which a corner area of the bundle of collected sheets is situated.

2. A copying machine as described in claim 1 wherein a control means is provided to activate the stapling means, the control means comprising at least one detector which reacts to a bundle of sheets manually inserted into the externally accessible opening to cause the stapling means to be activated.

3. A copying machine as described in claim 2 wherein the control means comprises two detectors, one situated before and to one side of a stapling location and the other situated behind and to the other side of the stapling location when viewed lengthwise of the externally accessible opening.

4. A copying machine as described in claim 1 wherein the stapling means is provided in the forepart of the copying machine near the operating side.

5. A copying machine as described in claim 4 wherein: the externally accessible opening is the same as the elongated opening through which the bundle of collected sheets is discharged from the support; the elongated opening can be closed by a first stop for retaining sheets fed onto the support; and the stapling means is arranged so that it can staple a bundle of sheets along an edge extending lengthwise of the elongated opening.

6. A copying machine as described in claim 5 wherein a control means is provided to activate the stapling means, the control means comprising at least one detector which reacts to a bundle of sheets manually inserted into the externally accessible opening to cause the stapling means to be activated.

7. A copying machine as described in claim 6 wherein the control means comprises two detectors, one situated before and to one side of a stapling location and the other situated behind and to the other side of the stapling location when viewed lengthwise of the externally accessible opening.

8. A copying machine as described in claim 7 wherein a second stop which extends in a direction parallel to the first stop is provided in the externally accessible opening beside the path of movement of sheets collected on the support, against which a bundle of sheets manually inserted into the externally accessible opening can be moved, and wherein one of the detectors is located before the second stop at a distance being considerably smaller than the distance between that detector and the edge of the second stop.

9. A copying machine as described in claim 5 wherein a first control means is provided which deactivates the first stop when no sheets are being processed in the copying machine.

10. A copying machine as described in claim 9 wherein a control means is provided to activate the stapling means, the control means comprising at least one detector which reacts to a bundle of sheets manually inserted into the externally accessible opening to cause the stapling means to be activated.

11. A copying machine as described in claim 10 wherein the control means comprises two detectors, one situated before and to one side of a stapling location and the other situated behind and to the other side of the stapling location when viewed lengthwise of the externally accessible opening.

12. A copying machine as described in claim 11 wherein a second stop which extends in a direction parallel to the first stop is provided in the externally accessible opening beside the path of movement of sheets collected on the support, against which a bundle of sheets manually inserted into the externally accessible opening can be moved, and wherein one of the detectors is located before the second stop at a distance being considerably smaller than the distance between that detector and the edge of the second stop.

13. A copying machine as described in claim 4 wherein a control means is provided to activate the stapling means, the control means comprising at least one detector which reacts to a bundle of sheets manually inserted into the externally accessible opening to cause the stapling means to be activated.

14. A copying machine as described in claim 13 wherein the control means comprises two detectors, one situated before and to one side of a stapling location and the other situated behind and to the other side of the stapling location when viewed lengthwise of the externally accessible opening.

* * * * *